United States Patent [19]

Vestlund

[11] 4,260,295

[45] Apr. 7, 1981

[54] INJECTOR

[75] Inventor: Elof Vestlund, Pixbo, Sweden

[73] Assignee: Trelleborg AB, Trelleborg, Sweden

[21] Appl. No.: 44,734

[22] Filed: Jun. 1, 1979

[51] Int. Cl.[3] ..... E02D 3/12

[52] U.S. Cl. ..... 405/269

[58] Field of Search ..... 405/233, 240, 223, 269

[56] References Cited

U.S. PATENT DOCUMENTS

| | | | |
|---|---|---|---|
| 2,960,831 | 11/1960 | Lonaberger et al. | 405/269 X |
| 3,108,442 | 10/1963 | Miller | 405/264 |
| 3,130,552 | 4/1964 | Bodine | 405/269 X |
| 4,074,735 | 2/1978 | McCabe et al. | 405/269 X |

*Primary Examiner*—David H. Corbin

*Attorney, Agent, or Firm*—Beveridge, DeGrandi, Kline & Lunsford

[57] ABSTRACT

An injector which is intended for the injection of material under high pressure through bores or other holes in rock or other solid material is provided with an injector pipe, a tubular shell, and injector nozzle and an expansion device which, during the injection operation, seals against the wall of the bore. The injector nozzle is releasable from the end of the injector pipe and is disposed to cooperate with a sleeve included in the expansion device in order to press the sleeve against the wall of the bore and in order, together with the sleeve, to form an expanded unit which, after the injection phase, is released from the injector pipe and remains, in the expanded state, in the bore. The injector nozzle is designed as a non-return valve, in that it has a cupola-like valve portion consisting of elastomer material and bridging the end of the injector pipe. The valve portion has through-flow slits which extend obliquely inwardly from the outside of the cupola-like valve portion in a direction towards the injector pipe, such that material pressure against the outside of the cupola-like valve portion realizes a sealing compression of the through-flow slits.

6 Claims, 6 Drawing Figures

INJECTOR

In tunneling operations and in the building of rock chambers in rock, it is a necessity that fissures and cracks in the rock be sealed in order, for example, to prevent water penetration and lowering of the ground water level, or in order to prevent liquid drainage from the tunnels or rock chambers if these are used for the storage or transport of liquids. This sealing may be effected in that cement or other sealing material, for example plastic, is injected under high pressure into bores. For purposes of retaining the high injection pressure, a sealing device is provided on prior art injectors for sealing against the circumferential surface of the bore. Normally, this sealing device is designed as a vacuum flask plug and comprises an elastomer sleeve which is either fixedly screwed, at its outer end, on an exterior thread on the outer end of the injector pipe, or supports with its end surface against a washer fixedly screwed on the injector pipe. Moreover, the inner end of the sleeve abuts against a tubular shell extending around the injector pipe. The outer end of the injector pipe is also exteriorly threaded and a locking nut is screwed onto this thread. By tightening the locking nut towards the outer end of the tubular shell, it is possible to deform the elastomer sleeve outwardly into sealing abutment against the circumferential surface of the bore. An example of such a prior art injector is shown in U.S. Pat. No. 2,960,831. Once sealing between the injector pipe and the wall of the bore has been realized, the injection operation is commenced through the injector pipe. The injection pressure may vary, but for cement is normally from 5-20 kp/cm$^2$, in dependence of the desired penetration depth in the cracks or fissures. After the injection process, it is necessary to maintain the injection pressure during hardening of the injected material and, consequently, the injector pipe, tubular shell and expansion sleeve of the prior art injector are allowed to remain in the bore until the sealing material has hardened. The pump unit of the injector is released from the components remaining in the bore and is moved to the next bore where injection is to take place and where, in a similar manner, an injector pipe, shell and expansion device are inserted. One disadvantage in the prior art injector is that the injector pipe with its tubular shell must remain in the bore, since, on the one hand, so many sets of injector components are needed such that the operation may proceed while the sealing material in the first injector bore hardens, and, on the other hand, the injector components are often broken when they are removed from the bore. Finally, the injector components are often difficult to remove and clean for renewed use. Moreover, much time is lost as a result of the waiting time and also as a result of the distances in the tunnels or rock chambers when personnel must return and remove the injector components.

The major aspect of the present invention is to obviate the above-mentioned disadvantages inherent in prior art injectors; and the invention, thus, relates to an injector for injecting material through bores or other holes in rock or other solid material, the injector comprising an injector pipe extending through a tubular shell the injector pipe having, at its outer end, a releasable injector nozzle designed as a non-return valve, and an expansion device cooperating with the shell and expandable by means thereof for sealing against the wall of the bore in which the injector is inserted.

According to the invention, the injector nozzle which is releaseable from the injector pipe, and an expansion sleeve included in the expansion device are disposed, during the expansion of the expansion device against the wall of the bore, to be coupled together for the formation of a unit constituting the expansion device and expanded against the wall of the bore, the unit being intended to be disconnected from the injector pipe and remain, in the expanded state, in the bore after the injection phase.

In such an instance, it is particularly advantageous if the injector nozzle is provided with a cupola-like valve portion consisting of elastomer material, this portion bridging the end of the injector pipe and having through-flow slits which are disposed to open on injection of the sealing material under pressure through the injector pipe and which are arranged to close on cancellation of the pressure of the sealing material in the injector pipe.

The cupola-like valve portion is preferably conical on its outside and preferably also on its inside, and the through-flow slits are preferably provided with discharge openings which, on observation of the injector nozzle in end elevation extend approximately along chords to the nozzle. In such a case, the through-flow slits should extend obliquely inwardly from the outside of the cupola-like valve portion in a direction towards the injector pipe. This design of the cupola-like valve portion will result in a powerfully self-sealing effect of the valve, since the pressure acting on the outside of the cupola-like valve portion will be propagated through this valve portion obliquely outwardly towards the base end of the valve portion, the pressure forcing together the through-flow slits in the cupola-like valve portion.

In order to attain a particularly powerful sealing effect on the through-flow slots, these should be provided by means of incision of the cupola-like valve portion without any appreciable removal of material. This may be effected in that the cupola-like valve portion is pierced by means of lancet-like cutting tools.

In order to facilitate expansion of the expansion sleeve, the circumferential surface portin of the injector nozzle in engagement with the expansion sleeve is preferably of frusto-conical form and turned with its narrowed end to face the expansion sleeve so that this frusto-conical portion of the circumferential surface may engage with a frusto-conical inner circumferential surface within the expansion sleeve. In order to attain a particularly high compression pressure of the expansion sleeve against the surrounding bore wall, it is particularly advantageous according to the invention if the injector nozzle be provided with a metal insert which extends substantially up to the base of the cupola-like valve portion and which is surrounded by merely a relatively thin layer of elastomer material.

The nature of the present invention and its aspects will be more readily understood from the following brief description of the accompanying drawings and discussion relating thereto.

In the accompanying drawings:

FIG. 1 schematically illustrates an injector according to the invention;

Figure 1:
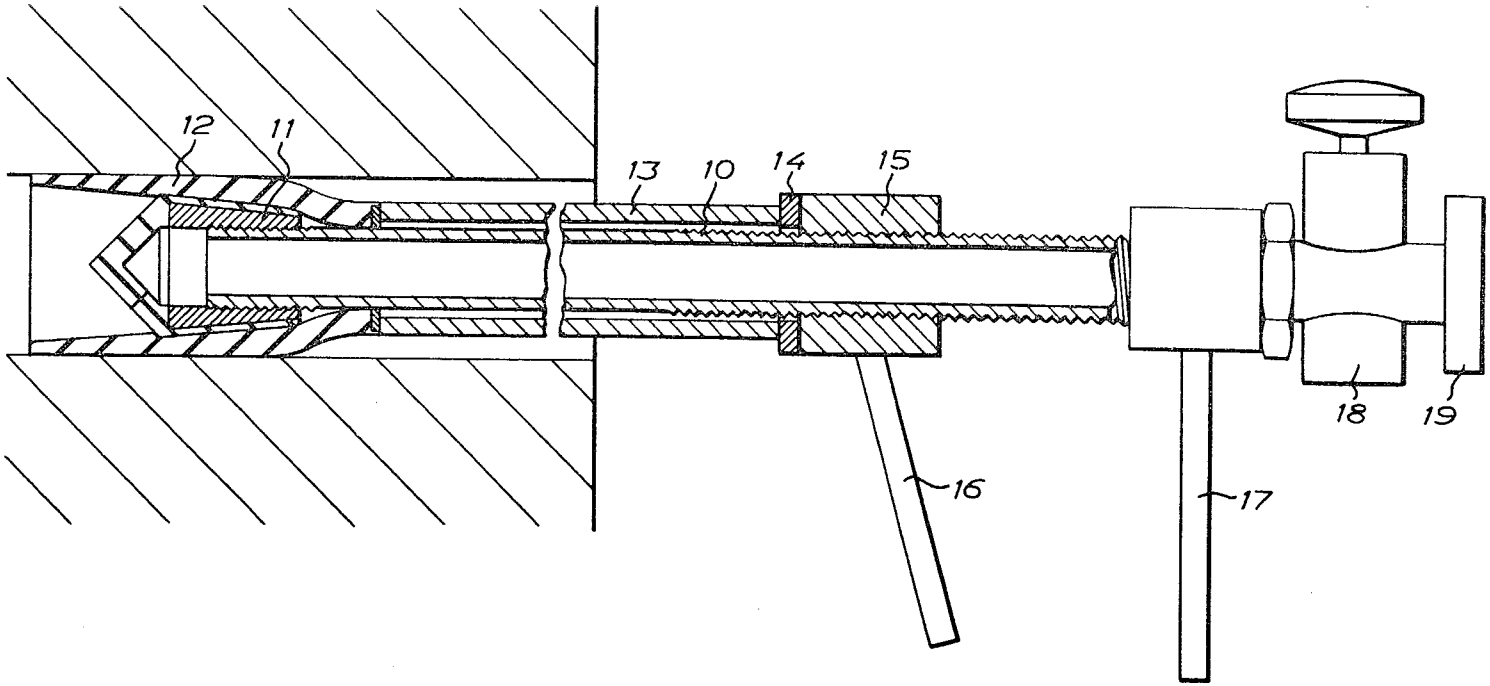

The injector according to the present invention comprises an injector pipe 10 which is threaded at its free end where an injector valve 11 is fixedly screwed-on. The more detailed design of this injector valve will be described below. The injector valve is disposed to cooperate with an expansion sleeve 12 whose construction will also be described in greater detail below. A tubular shell 13 is passed over the injector pipe 10. This shell supports on the end surface of the expansion sleeve 12 and is, with its other end, in engagement with a sliding ring 14 which, in turn is in engagement with a nut 15 which may be screwed to a thread on the outside of the injector pipe 10. The nut 15 is provided with a handle 16 for facilitating this screwing action. At the end of the injector pipe, a further handle 17 has been fixedly disposed in order to make it possible to hold the injector pipe still while the nut 15 is screwed in towards the shell 13 by means of the handle 16. By screwing in the nut 15 towards the shell 13, it is possible to cause the injector valve 11 to penetrate into the concial interior of the expansion sleeve 12 in order to expand the expansion sleeve 12 into sealing abutment against the surrounding bore.

At the outer end of the injector pipe 10 there is provided a faucet 18 by means of which the injector pipe may be closed. Finally, a bayonet catch 19 is also disposed at the outer end for coupling the injector to pumping equipment.

According to the invention, the injector pipe 10 has, thus, at its outer end, an injector nozzle which is releasably mounted on the outer end of the injector pipe and is designed as a non-return valve. This injector nozzle forms, together with the expansion sleeve 12 supported by the shell 13, the requisite expansion device for realizing sealing engagement between the injector and the circumferential wall of the surrounding bore.

Figure 2:
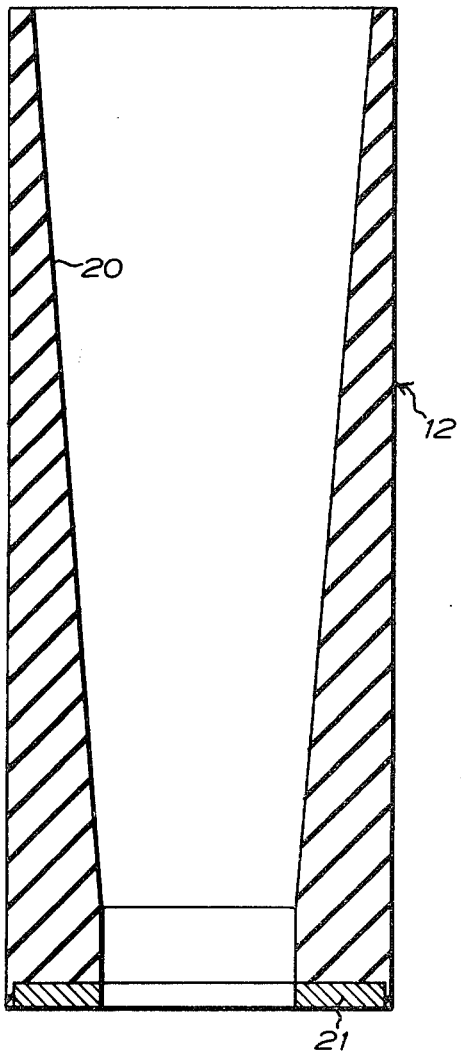
FIG. 2 is an axial section through an expansion sleeve included in the injector.

As is apparent from FIG. 2, the expansion sleeve 12 is designed as a tubular member with a conical inner circumferential surface 20. The major portion of the expansion sleeve is made of elastomer material which is united during a vulcanization process, to a pressure distribution washer 21.

The injector valve 11 has an inner metal body 22 which has a through bore 23 which is threaded for the screwing-in of the outer end of the injector pipe 10. The discharge of the metal body is bridged by means of a cupola-like elastomer portion 24 which, in the illustrated embodiment, is in the form of a cone with a conical inside and outside. This cone merges into a sealing layer 25 which extends about the body 22 and is relatively thin. The injector valve 11 is provided with a number of through-flow slits 26 which are formed in that the elastomer material in the cupola-like valve portion 24 has been pierced with a lancet knife without any actual removal of material. The through-flow slits 26 are, in the illustrated embodiment, directed obliquely inwardly towards the discharge of the injector pipe which is screwed into the thread of the metal body.

Figure 3:
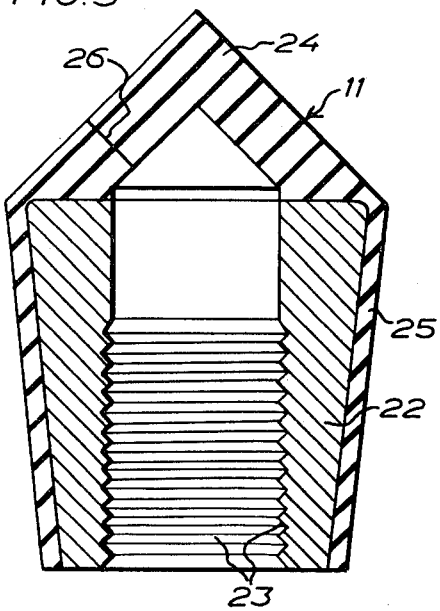
FIG. 3 is an axial section through an injector nozzle included in the injector.
Figure 4:
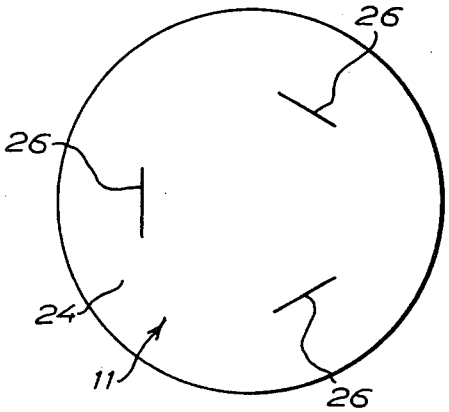
FIG. 4 is a plan view of the injector nozzle of FIG. 3, seen from the tip end.

As is apparent from FIG. 3 and 4, the through-flow slits 26 are directed substantially along chords to the valve portion 24 when this is observed in end elevation in accordance with FIG. 4. The through-flow slits extend, in the illustrated embodiment, at right angles to the conical surface of the valve portion 24. As a result, the best compression of the through-flow slits will be obtained when the valve is to serve as a non-return valve during the hardening phase of the injected material.

The function of the injector according to the invention is as follows.

When the injection process is to be commenced, the injector valve is placed outside expansion sleeve 12, such that the expansion sleeve and the injector valve may easily be inserted into the bore in the rock wall or other solid material. When these components have been inserted a sufficient distance into the bore, the nut 15 is screwed in along the injector pipe 10 until the injector valve 11 has been drawn a good distance into the expansion sleeve 12 which, as a result, is forced into sealing abutment against the circumferential surface of the surrounding bore. The injector valve and expansion sleeve will, in this instance, be coupled by friction so as to form a unit. Thereafter, the injection of sealing material such as cement or other suitable material is commenced if the object of the injection is for sealing purposes. The pressure in the injected material will stretch the rubber material in the cupola-like valve portion 24, such that the injected material may pass through the slits 26. When enough material has been injected, the pressure in the injector pipe is relieved, in which instance the pressure prevailing in the bore on the other side of the cupola-like valve portion 24 will act on this valve portion and powerfully compress the through-flow slits 26 such that no material can force its way back into the injector pipe. Hereafter, the injector pipe is unscrewed from the thread in the body 22, the entire expansion device, including the injector valve being retained as a unit in the bore. The tubular shell and injector pipe may, thus, be moved directly to the next bore where injection is to take place. As a result, circumstantial cleaning work is avoided, as well as the earlier long waiting times before the injector components can be removed from the bore.

The injector according to the invention provides, thus, considerable advantages, above all as a result of reduced time loss, since, in the use of the prior art injector equipment, almost half of the labor time is used as waiting time and for the preparation of material. Furthermore, the need for injector pipes and tubular shells will be reduced, since these items may be removed immediately after the termination of the injection phase. This also provides the advantage that these items become easier to clean, since the material being injected is still soft. The results of the injection phase will also show an improvement, since, in the utilization of prior art equipment, the requisite hardening time is sometimes not always followed sufficiently, for example because some other working phase must be carried out. The consequences of this shortcoming may be that the pressure in the bore changes and that leakage occurs. Moreover, the costs for the injector nozzle and expansion sleeve will be but a fraction of the costs of stock management and maintenance of a great number of sets of prior art injector components.

Figure 5:
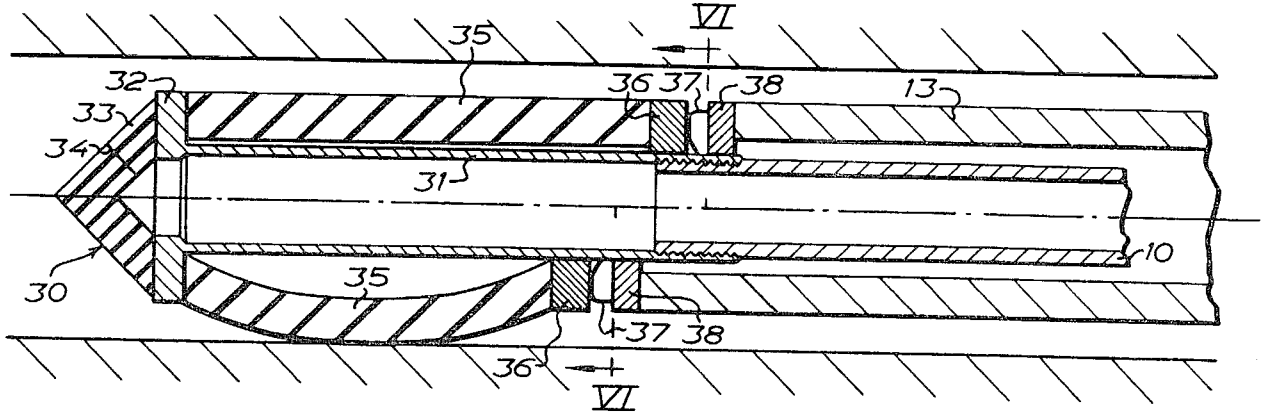
FIG. 5 is an axial section through a portion of a further example of an injector according to the invention.
Figure 6:
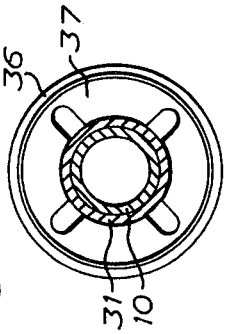
FIG. 6 is a section taken along the line VI—VI in FIG. 5.

FIGS. 5 and 6 illustrate a further embodiment of the present invention. FIG. 5 shows only the injector nozzle proper and a short stump of the injector pipe and its shell. The lower half of the section shows the expansion device in the expanded state, whereas the upper half shows the expansion device in the relaxed state prior to expansion. As will be apparent from the Figure, the injector is provided with an injector nozzle 30 which has an elongate sleeve which is interiorly threaded at one end. At its other end, the sleeve has a flared flange 32. At this flange, a cupola-like elastomer portion 33 is fixedly mounted, under a vulcanization process, and bridges the passage through the sleeve 31. The cupola-like elastomer portion is also, in this embodiment, in the form of a cone with a conical inside and outside. The cone has a number of through-flow slits 34 which have been formed in that the elastomer material in the cupola-like valve portion 33 has been pierced by a lancet knife without any actual removal of material. As in the above-described embodiment, the through-flow slits 34 are directed obliquely inwardly towards the passage through the sleeve 31.

A rubber sleeve 35 is fitted over the sleeve 31. Outside this rubber sleeve, there is a sliding ring 36 against whose outside abuts a locking washer 37. A further sliding ring 38 is in abutment against the outside of the locking washer. When the injector is to be used, the injector pipe 10 is screwed in to the interior threading of the sleeve 31, a tubular shell 13 having been passed beforehand over the outside of the injector pipe. The tubular shell 13 and the injector pipe 10, together with the remainder of the injector, are designed in the same manner as the previously described embodiment.

When the injector is to be inserted into a bore, the various components assume those positions shown at the top in FIG. 5. After insertion to the requisite depth in the bore, the nut 15 is tightened by means of the handle 16 (please see FIG. 1), such that the tubular shell 13 is brought to be forced inwardly towards the sliding ring 38. In its turn, the sliding ring is shifted against the locking washer 37 which is shifted, together with the sliding ring 36, such that the rubber sleeve 35 is deformed and pressed outwardly into sealing abutment against the wall of the bore, as is clearly illustrated at the bottom in FIG. 5.

Since the locking washer 37 is designed with locking and jamming tongues 38, it may be shifted only to the left with respect to FIG. 5 and, as a result, the expansion of the expansion device which is formed of the injector nozzle 30 and the sleeve 35 fitted thereon, will be retained even when the injector pipe 10 has been unscrewed from the inner thread in the sleeve 31 and has been removed together with the tubular shell 13. Hencve, the function of this embodiment is the same as the function of the embodiment of the invention described in conjunctin with FIG. 1.

The invention may be used not only for the injection of sealing materials through bores or other holes in rock or other solid material, but may also be used for the injection of insulating materials into, for example, cavities in vessel hulls or the like. In such an instance, the hole through which the injector is passed may consist of, for example, a pipe socket instead of a bore. Another field of use for the injector according to the invention is in the injection of cement or other hardening material under concrete road paving in order to correct settling in them.

What I claim and desire to secure by Letters Patent is:

1. An injector for injecting material through bores or other holes in rock or other solid material, comprising, a tubular shell;

an injector pipe extending through the tubular shell;

a unit coupled to the injector pipe and comprising an injector nozzle and an expansion device;

said injector nozzle including a non-return valve means;

said expansion device including a sleeve which is expandable into sealing engagement with the wall of a bore or hole in response to axial forces exerted on the sleeve by the tubular shell; and means on said unit for maintaining said sleeve in its expanded state after the axial forces exerted thereon by said tubular shell have been released;

said unit being releasable from said injector pipe and said tubular shell, whereby the sleeve is maintained in its expanded state to retain the unit in the bore or hole.

2. The injector as recited in claim 1, wherein said injector nozzle (11) is provided with a cupola-like valve portion of elastomer material, bridges the end of said injector pipe (10), and has through-flow slits (26) which are disposed to open on the injection of the sealing material under pressure through said injector pipe, and which are disposed to reclose on the cancelation of the pressure of the sealing material in the injector pipe.

3. The injector as recited in claim 2, wherein said cupola-like valve portion (24) has a conical exterior surface, and wherein said through-flow slits (26) have discharge openings which, on observation of the injector nozzle (11) in end elevation, extend approximately along chords to the nozzle.

4. The injector as recited in claim 2 or 3, wherein said through-flow slits (26) extend obliquely inwardly from the outside of the cupola-like valve portion (24) in a direction towards the injector pipe (10).

5. The injector as recited in claim 2 or 3, wherein said through-flow slits (26) are provided by incision of the cupola-like valve portion (24) without appreciable material removal.

6. The injector as recited in claim 5, wherein said through-flow slits (26) extend obliquely inwardly from the outside of the cupola-like valve portion (24) in a direction towards the injector pipe (10).

* * * * *